US006907830B2

(12) United States Patent
Guinan et al.

(10) Patent No.: US 6,907,830 B2
(45) Date of Patent: Jun. 21, 2005

(54) MULTIPOINT LOCK ASSEMBLY

(75) Inventors: Terrance Leocyn Guinan, East Malvern (AU); Michael John Cardinal, Highton (AU)

(73) Assignee: Diebold Self-Service Systems, North Canton, OH (US)

( * ) Notice: Subject to any disclaimer, the term of this patent is extended or adjusted under 35 U.S.C. 154(b) by 0 days.

(21) Appl. No.: 10/449,982

(22) Filed: May 30, 2003

(65) Prior Publication Data

US 2003/0221596 A1 Dec. 4, 2003

(30) Foreign Application Priority Data

May 31, 2002 (AU) ..... PS2730

(51) Int. Cl.[7] ..... G07G 5/00

(52) U.S. Cl. ..... 109/24.1; 109/59 R; 292/341.15; 292/302; 292/36

(58) Field of Search ..... 109/24.1, 59 R; 292/26, 30, 35, 158, 159, 302, 341.15

(56) References Cited

U.S. PATENT DOCUMENTS

| | | | | | |
|---|---|---|---|---|---|
| 307,937 | A | * | 11/1884 | Grove | 109/68 |
| 908,770 | A | * | 1/1909 | Hartman | 232/41 D |
| 1,052,770 | A | * | 2/1913 | Thorn | 292/159 |
| 1,280,993 | A | * | 10/1918 | Hammer | 292/159 |
| 1,463,182 | A | * | 7/1923 | Voss | 70/118 |
| 2,666,661 | A | * | 1/1954 | Segal | 292/159 |
| 3,175,873 | A | * | 3/1965 | Blomquist et al. | 312/296 |
| 3,586,360 | A | * | 6/1971 | Perotta | 292/26 |
| 3,994,543 | A | * | 11/1976 | Melugin | 384/435 |
| 4,617,811 | A | * | 10/1986 | Roop | 70/131 |
| 4,989,908 | A | * | 2/1991 | Futch et al. | 292/341.15 |
| 4,997,218 | A | * | 3/1991 | Culling | 292/60 |
| 5,544,506 | A | * | 8/1996 | Nakano | 70/34 |
| 5,784,973 | A | * | 7/1998 | Mercer et al. | 109/59 R |
| 5,905,244 | A | * | 5/1999 | Smith et al. | 218/155 |
| 6,089,168 | A | * | 7/2000 | Dunlap et al. | 109/59 R |
| 6,543,821 | B1 | * | 4/2003 | Weinerman et al. | 292/123 |
| 6,561,604 | B2 | * | 5/2003 | Leccia et al. | 312/326 |
| 6,676,175 | B2 | * | 1/2004 | Jaeb et al. | 292/116 |
| 6,679,087 | B2 | * | 1/2004 | Suggs et al. | 70/153 |

* cited by examiner

*Primary Examiner*—Suzanne Dino Barrett
(74) *Attorney, Agent, or Firm*—Daniel D. Wasil; Ralph E. Jocke; Walker & Jocke

(57) ABSTRACT

An enclosure lock comprises at least one keeper 2 and latch 5. The keeper is mounted to an interior of the enclosure body 18. The latch is mounted to the interior side of the enclosure door 1. The keeper includes spaced projecting lugs 3 having an aperture 4 therebetween. The latch includes a mount 6 having a projecting lug 7 and a slidable bolt 8. The bolt includes spaced projecting lugs 12 having an aperture 13 therebetween. The bolt can slide between door locking and unlocking positions. When the door is closed, the mount lug 7 is positioned within the keeper aperture 4. The bolt lugs 12 can then be slid to the locking position behind the keeper lugs 3 to lock the door to the enclosure body. The locking arrangement prevents the door from being opened by rotating the door or by laterally sliding the door.

21 Claims, 6 Drawing Sheets

MULTIPOINT LOCK ASSEMBLY

TECHNICAL FIELD

This invention relates to security locking systems as applied to the access points of secure enclosures, such as safes and automatic teller machines. In particular, the invention relates to a lock adapted to provide auxiliary locking to such access points which rely on a hinged or pivoted opening action.

BACKGROUND ART

A vast range of primary and auxiliary locking systems are available for secure enclosures ranging from simple box locks to highly complex multipoint locking systems as applied to high security safes.

The type of locking system required for any given situation is governed by the level of security, the nature of the enclosure concerned and the manner in which the access point of the enclosure operates. Generally the access point of a given enclosure will operate by way of a hinged and pivoting action or by way of a sliding action.

The locking systems applicable to these two different modes of access point operation clearly require different locking mechanisms and both systems provide strengths and weaknesses of design.

A particular weakness of the hinged access point system involves the vulnerability of the hinged region which can be exposed to tampering and/or vandalism and when such access points or doors are secured only by a sliding bolt system on the free end, the removal of the hinging mechanism will allow such doors to be moved by a simple sliding action to withdraw the whole door and sliding bolt from the enclosure and the enclosure's keeper. In order to address such problems, pivoted doors can be provided with combination sliding and drop bolting systems and/or provided with projecting tabs at the hinged edge of the door which can be adapted for insertion into indentations at or near the hinged edge of the enclosure. Whilst such features assist in improving security of such enclosures, such locking systems are still vulnerable to vandalism where both the hinge region and the tab region can be exposed to attack thereby again leaving the door able to be removed by a sliding action simply withdrawing the slide bolt from the enclosure's keeper.

Such a situation applies to the design and construction of automatic teller machines (ATMs) which provide an enclosure in the form of a steel cuboid box having a rear hinged door as the primary access point. Such automatic teller machines rely on two robust hinges applied to the top and bottom of the door and projecting tabs along the pivot edge of the door which insert into indentations formed in the edge of the enclosure. The sliding bolt of the automatic teller machine operates from the other side of the door and engages the keeper formed in the enclosure.

To date, such automatic teller machines remain vulnerable and can be attacked with a blow torch to remove the top and bottom hinges and the tabbing system.

Such an attack leaves these doors vulnerable and an auxiliary locking system to enhance the current sliding bolt system to prevent the opening of such doors either by rotation around the hinges or by sliding action would be desirable.

DISCLOSURE OF INVENTION

It is an object of an exemplary form of the present invention to provide a lock for fitting to an enclosure having a pivotally openable door. The lock comprises a keeper and a latch assembly. The keeper includes at least two projecting spaced apart first lugs having a first aperture between adjacent lugs. The latch assembly includes a mount having a mount plate with a projecting lug adapted for fitting to the door and a movable bolt including at least one second lug. The bolt is adapted for movement between a first unlocked position and a second locked position. In the first unlocked position the projecting lug is aligned with the projecting lug of the mount and the aligned lugs are adapted to cooperate with the keeper by traversing the first aperture thereof as the door is closed, such that the projecting lug of the mount is positioned within the first aperture of the keeper and the projecting lug of the bolt is free to slide to the second position. In the second locked position the projecting second lug of the bolt is aligned behind one of the projecting first lugs of the keeper so as to prevent the door from opening by rotation about the pivot or by lateral sliding action.

It is a further object of an exemplary form of the present invention to provide a lock for fitting to an enclosure having a pivotally openable door. The lock comprises a a keeper and a latch assembly. The keeper includes at least two projecting spaced apart first lugs having a first aperture between adjacent lugs. The latch assembly includes a mount having a mount plate with a projecting lug adapted for fitting to the door and a slidable bolt. The bolt includes at least two projecting spaced apart second lugs, the lugs having a second aperture between adjacent lugs, wherein the sliding bolt is adapted for movement between a first unlocked position and a second locked position. In the first unlocked position one of the projecting second lugs is aligned with the projecting lug of the mount and the aligned lugs are adapted to cooperate with the keeper by traversing the first aperture thereof as the door is closed, such that the projecting lug of the mount is positioned within the first aperture of the keeper and the projecting lugs of the bolt are free to slide to the second locked position. In the second locked position the projecting second lugs of the sliding bolt are aligned behind the projecting first lugs of the keeper so as to prevent the door from opening by rotation about the pivot or by lateral sliding action.

The slidable bolt may include a keyway for guiding the movement of the bolt relative to the mount and to provide limited travel between the unlocked and locked positions.

The projecting lug of the mount is preferably of about the same thickness as the spaced lugs of the keeper so as to ensure a snug locking operation of the lock against rotational opening of the door.

The width of the first and second apertures is preferably marginally wider than the lugs to allow or ensure ready traversal thereof during opening and closing of the door whilst providing or ensuring sufficient purchase to achieve secure locking in the locked positions.

The sliding bolt may be attached to the mount by a faceplate.

The lock may be used as a primary lock or an auxiliary lock, and when used as an auxiliary lock may be activated by the primary lock. Activation linkage may be adapted to cooperate with a primary lock fitted to the door such that the activation of the primary lock automatically activates the auxiliary lock. An auxiliary lock may be fitted to a door about midway along the top and bottom of the door between the primary lock and a door pivot axis.

The lock is preferably positioned about midway along the top and bottom of the door between the primary lock assembly and the door pivot axis. The auxiliary lock may be fitted to the door.

It is a further object of an exemplary form of the present invention to provide an improved secure enclosure wherein the door of the enclosure is provided with one or a plurality of the locks as previously described. The enclosure, for example, may be a safe, an automatic teller machine, an automatic teller machine enclosure, or an automatic teller machine safe.

It is a further object of an exemplary form of the present invention to provide a method of enhancing the security of a secure enclosure including the provision one or a plurality of auxiliary locks of the type described to a pivotally opening door of the enclosure. In a method of enhancing the security of a secure enclosure, the enclosure, for example, may be a safe, an automatic teller machine, an automatic teller machine enclosure, or an automatic teller machine safe.

Further objects of exemplary embodiments of the present invention will be made apparent in the following Best Mode For Carrying Out Invention and the appended claims.

BEST MODE FOR CARRYING OUT INVENTION

Figure 1:
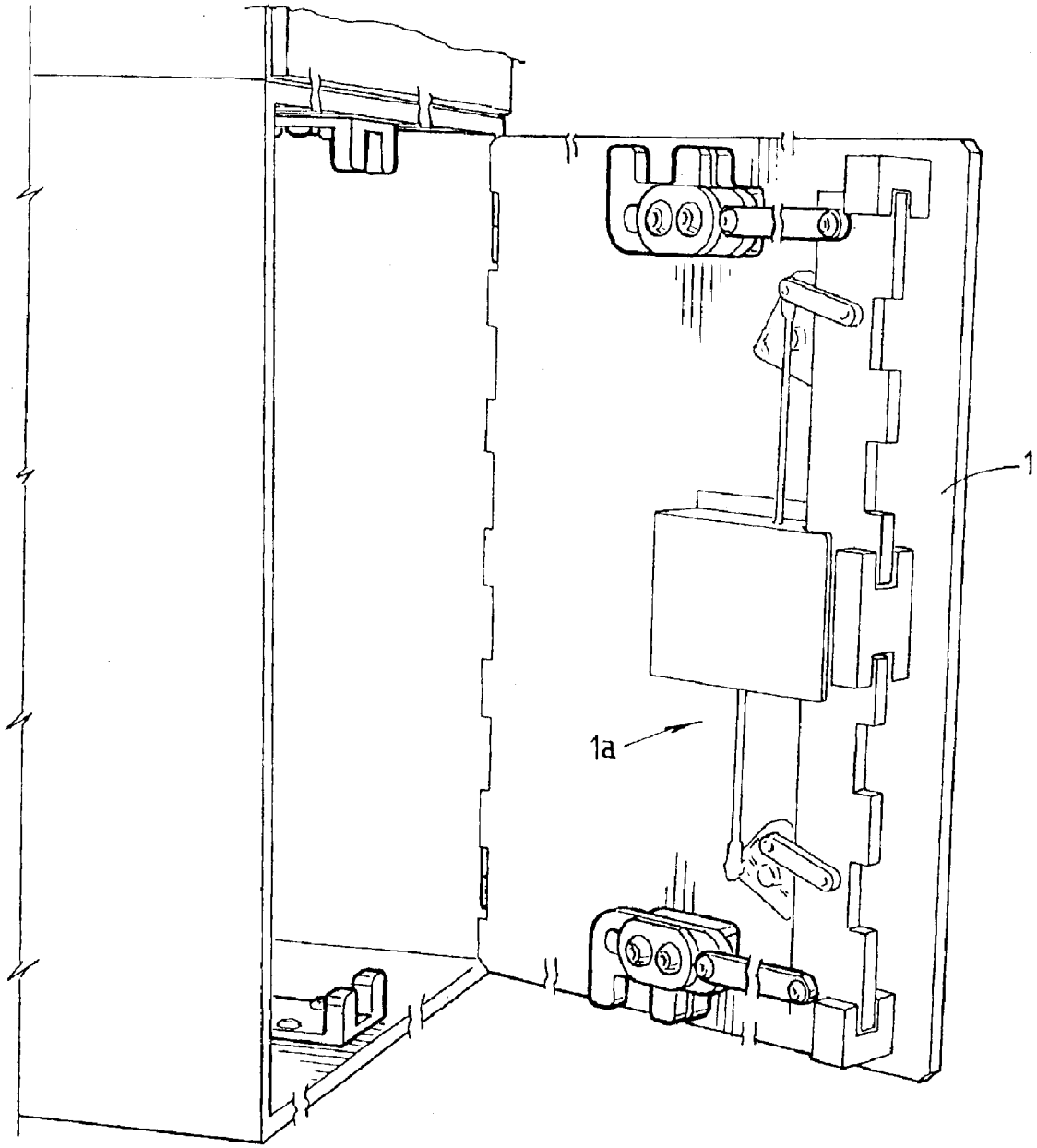
FIG. 1 shows a lock fitted at two places to a safe door.

Referring to FIG. 1, the lock of the invention can be seen as being fitted or fastened to the back of an enclosure door 1 about midway along the width of the door on the top and bottom edges.

The door in this example is from an automatic teller machine (ATM) safe enclosure which is provided with its primary locking assembly 1*a* in the form of a sliding bolt system. The ATM enclosure door is an example of a pivotally hinged door where the pivot points are located opposite the primary locking system. An example of an ATM with a primary locking assembly is shown in U.S. Pat. No. 6,089,168, the disclosure of which is incorporated herein by reference in its entirety. In an exemplary form of the invention the lock is readily adapted for retrofitting as an auxiliary lock to a range of situations, and it is adapted for retrofitting or de novo-fitting to ATM enclosure doors. It should further be understood that while the exemplary embodiment described herein is in the form of an ATM, the present invention may be used in connection with other types of automated transaction machines or automated banking machines. Machine features and components may be of the type shown in U.S. patent application Ser. No. 09/911,329 filed Jul. 23, 2001, the disclosure of which is incorporated herein by reference in its entirety.

Figure 2:
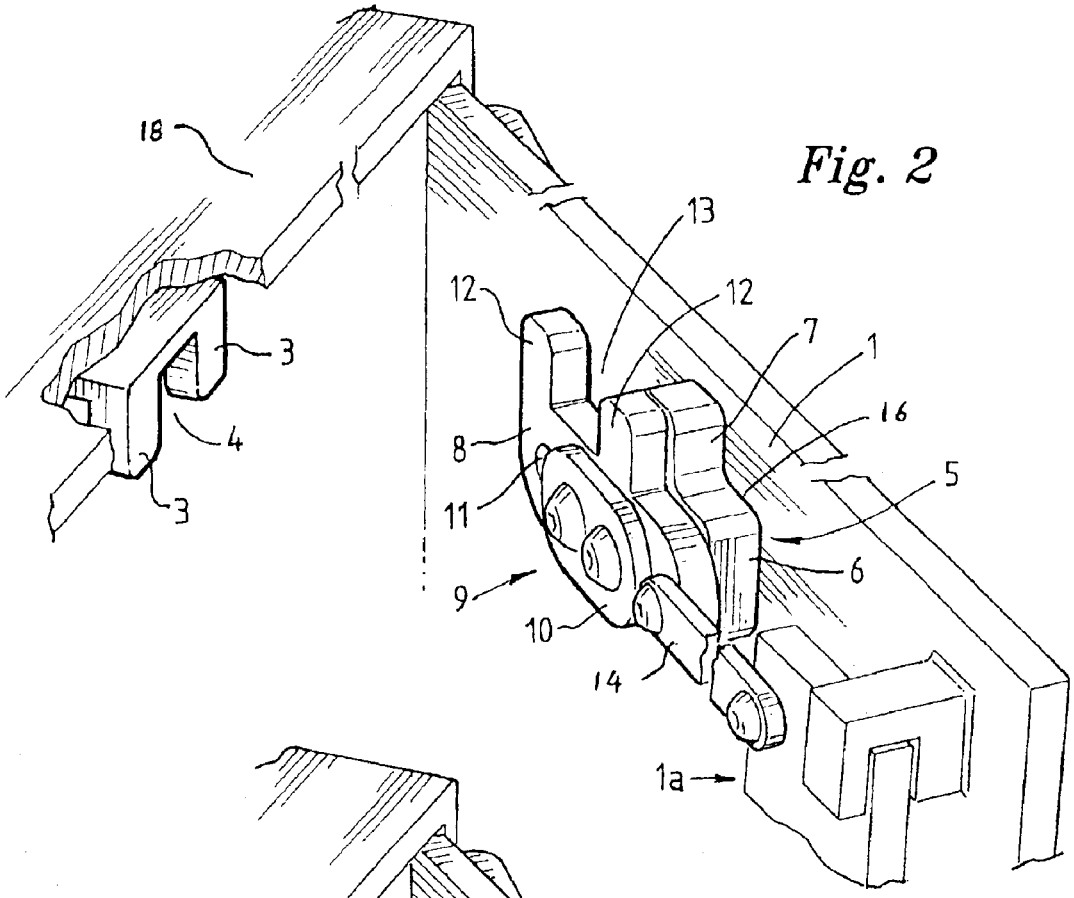
FIG. 2 shows a lock fitted as an auxiliary lock to a safe. A latch of the lock is in an unlocked position.
Figure 3:
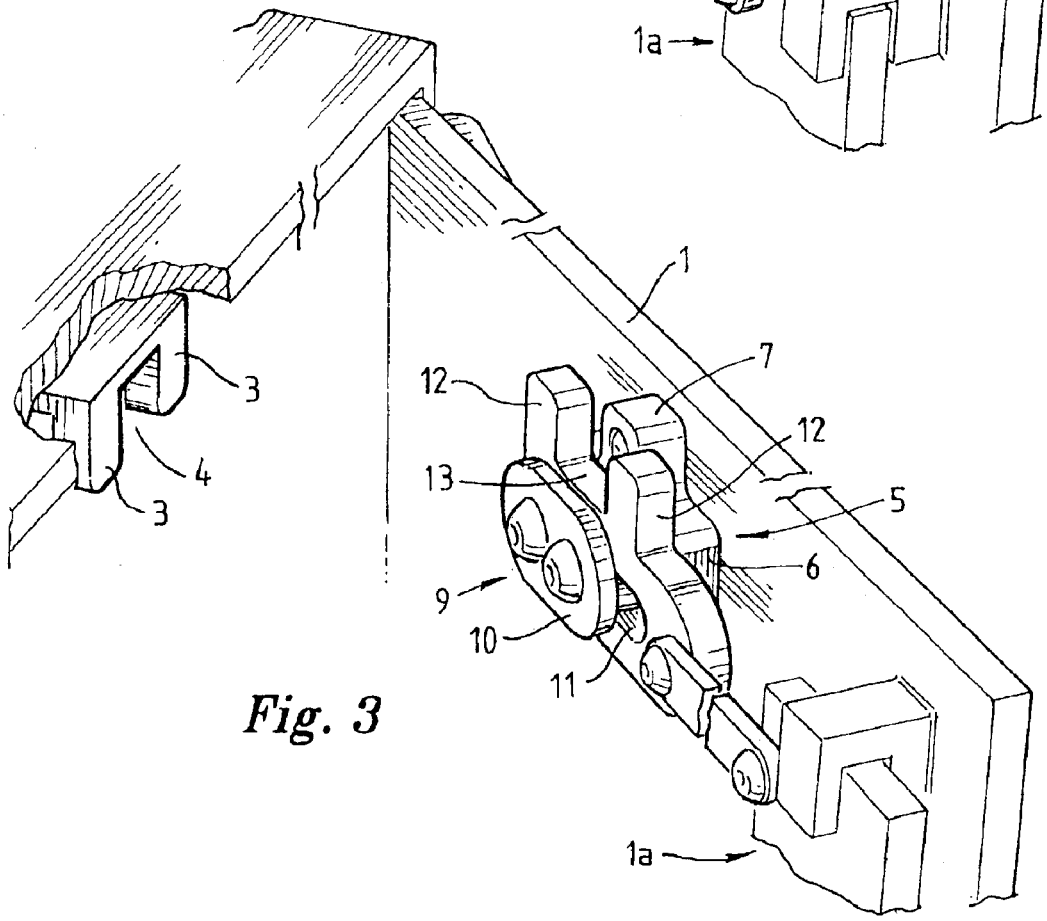
FIG. 3 shows another close up with the latch of the lock in a locking position.
Figure 4:
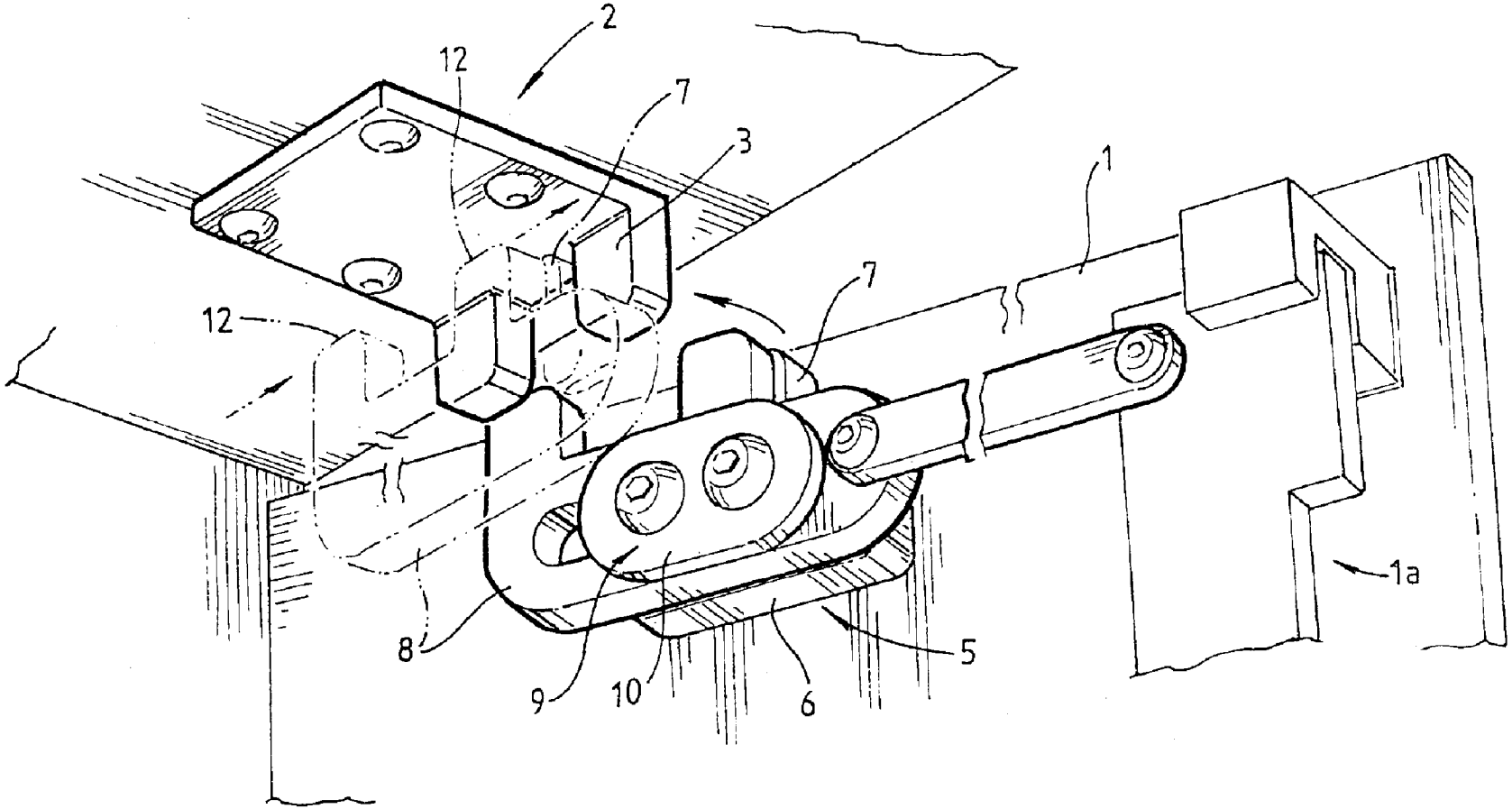
FIG. 4 shows an interior perspective view of the top lock and an open safe door.

FIGS. 2 and 3 provide close up views of an exemplary embodiment of a multipoint lock assembly of the invention. The lock includes a latch assembly 5 and a keeper 2. FIG. 2 shows the latch assembly in an open or unlocked position. FIG. 3 shows the latch assembly in a locked position. FIG. 4 shows an internal view of the enclosure where the enclosure door 1 is partially opened to reveal the latch assembly and an associated keeper 2.

In the exemplary embodiment the keeper 2 is adapted for fitting to the top and bottom of the enclosure body 18. The keeper assembly 2 can include two projecting spaced apart first lugs 3. The first lugs 3 may project into the internal space of the enclosure body. The two lugs 3 are separated by a first gap or aperture 4. The keeper 2 acts in conjunction with the latch 5 to keep or prevent the door from being opened.

In the exemplary embodiment the latch assembly 5 includes a mount 6 comprising a mount plate 16 and a projecting lug 7. The mount lug 7 can be integrally formed as part of the mount plate. The projecting lug 7 is of similar proportion to the spaced lugs 3 of the keeper 2. The width of the projecting lug 7 can be sized and configured to be marginally smaller than the first aperture 4 of the keeper. The mount 6 is adapted for secure fixing to the rear of the enclosure door 1 and provides the mounting and fitting for the rest of the latch assembly. The latch assembly further includes a sliding plate or bolt 8. The sliding bolt 8 is adapted to move between unlocked and locked positions relative to the mount 6. The sliding bolt 8 is fitted to the mount 6 by fixing structure 9. The fixing assembly 9 may include bolts or screws. The fixing assembly 9 holds a faceplate 10 by way of an opening or slot or keyway 11 formed in the sliding bolt 8. The keyway 11 provides a limited range of movement for the sliding bolt in the lateral direction from the unlocked to the locked position. The backward and forward action of the sliding bolt allows the latch to operate from the unlocked position shown in FIG. 2 to the locked position shown in FIG. 3. The bolt 8 is adapted to slide into a locking position relative to the keeper 2 to prevent the door from being pivoted open.

In the exemplary embodiment the sliding bolt 8 is provided with two spaced apart second lugs 12. The lugs 12 rise above the sliding bolt and are sized and configured such that in an unlocked position, one of the lugs 12 substantially aligns with the mount projecting lug 7. The spaced lugs 12 are separated by a second aperture 13 therebetween. The lugs 12 may be dimensioned to be marginally larger than the first lugs 3 of the keeper.

The number of lugs can be varied in the keeper, the bolt, and the mount. A minimum of two lugs in the keeper provides optimal lateral sliding security by preventing sliding movement of a mount projecting lug in both lateral directions.

Figure 5:
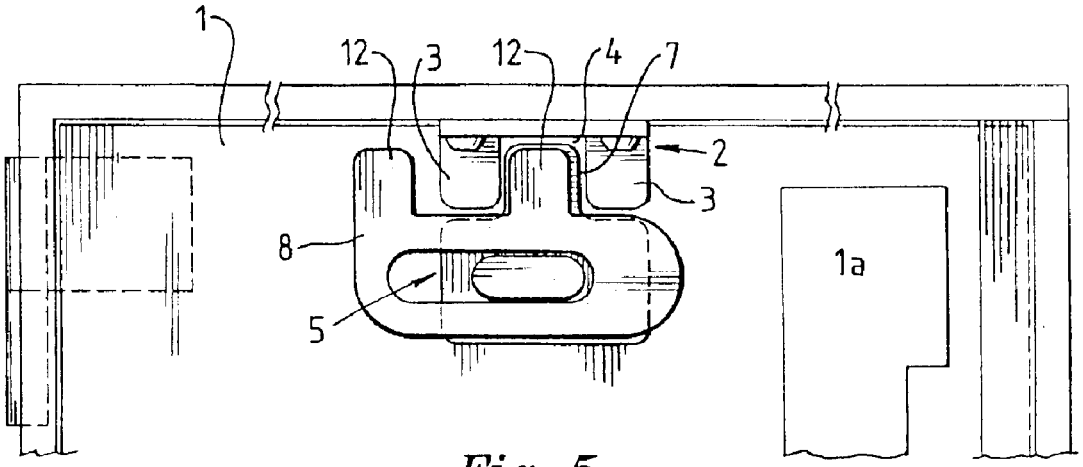
FIG. 5 shows an interior front view of the keeper, sliding bolt, and mount plate fitted to a closed safe door in the unlocked position.
Figure 6:
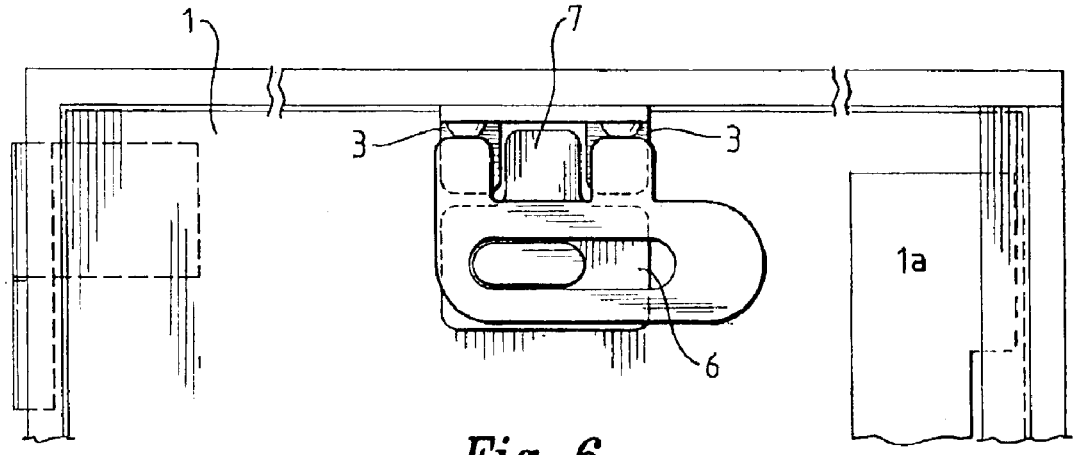
FIG. 6 shows the mount plate, sliding bolt, and keeper in the locked position.
Figure 7:
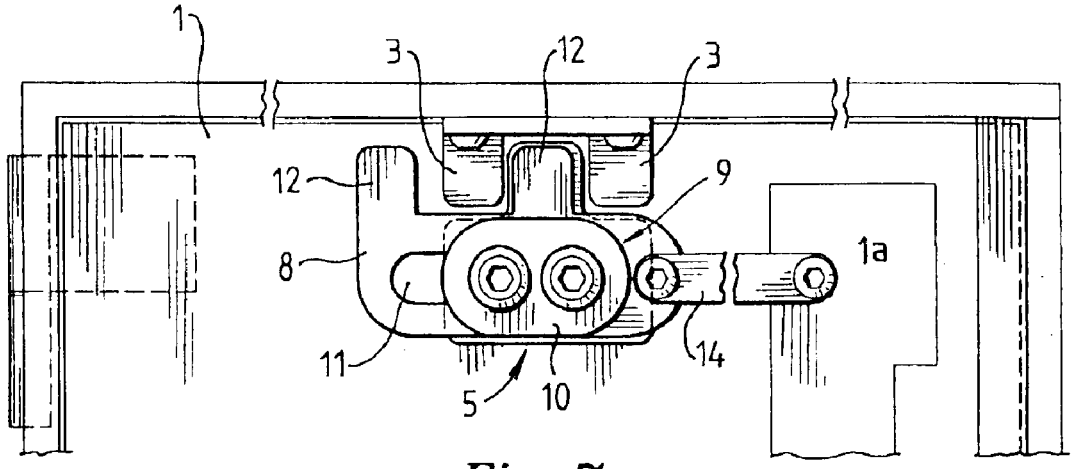
FIG. 7 shows a close up view of the assembled and fitted open lock relative to a closed safe door.

The action of the lock can be best seen with reference to FIGS. 5 to 7 which show a schematic internal view of a closed enclosure demonstrating the cooperation between a keeper and a latch assembly of the lock. Referring now to FIG. 5, the enclosure door 1 is seen from the inside in its closed position with a primary lock la positioned at the door edge removed from the door pivot axis edge. The lock is positioned midway along the door 1 with a keeper 2 secured to the top of the enclosure body. The keeper lugs 3 are arranged in a downward projecting direction toward the interior of the enclosure and in a position to generally abut the closed door 1. The lugs 3 have a side surface which can neatly abut the door when the door is in a closed position.

The latching assembly 5 has the mount 6 fixed to the inside of the enclosure door 1. The mount 6 is positioned so as to cooperate with a keeper with the projecting lug 7 of the mount fitting snugly within the aperture 4 formed between the spaced lugs 3 of the keeper 2. The sliding bolt 8 can be seen in FIG. 5 in the unlocked position. As shown, one of the spaced lugs 12 is aligned with the mount projecting lug 7. These aligned lugs 7, 12 both are allowed to traverse or pass through the keeper's aperture 4 during the opening and closing of the door by rotation about the pivot points.

Referring now to FIG. 6, the detail of the cooperation between the keeper lugs 3 and the mount lug 7 can be clearly seen. The projecting lug 7 is positioned between the spaced keeper lugs 3 when the enclosure door 1 is closed. The lugs 3 keep the mount lug 7 from being moved laterally beyond the space between the lugs 3. This positioning forms a first locking action by ensuring that the door cannot be moved laterally whilst it is substantially in the closed position. The keeper and latch arrangement ensures that vandalism of the enclosure door by removal of the hinges will not allow the door to be opened by sliding it in a lateral direction and thereby sliding the primary lock bolt from its keeper.

Referring now to FIG. 7, a view of the completed lock is shown where the sliding bolt 8 is positioned on top of the mount 6 and secured thereto by fixing assembly 9 and a secure faceplate 10. The sliding bolt 8 is provided with an elongated keyway 11. The keyway allows the bolt 8 to move between its unlocked position (as shown in FIG. 7) and a locked position. In a locked position the sliding bolt 8 is slid or drawn back in the keyway so as to align the bolt lugs 12 with and behind the keeper lugs 3. Thus, the bolt lugs 12 are located in an aligned position behind the keeper lugs 3. This bolt positioning forms a second locking action. The keeper and latch arrangement, with the alignment of the respective keeper lugs 3 and the latch lugs 12, ensures that the door cannot be opened by way of pivotal movement. The keeper 2 is two-way keeper by preventing both lateral and pivotal door movement. The combined action of the first and second locking actions of the lock provides a high level of additional or auxiliary security.

The sliding bolt 8 may be further provided with an extension arm 14 which may be linked to the primary lock 1 a so as to allow for the automatic activation and deactivation of the auxiliary lock and the coordination thereof with the activation of the primary lock of the enclosure.

Figure 8:
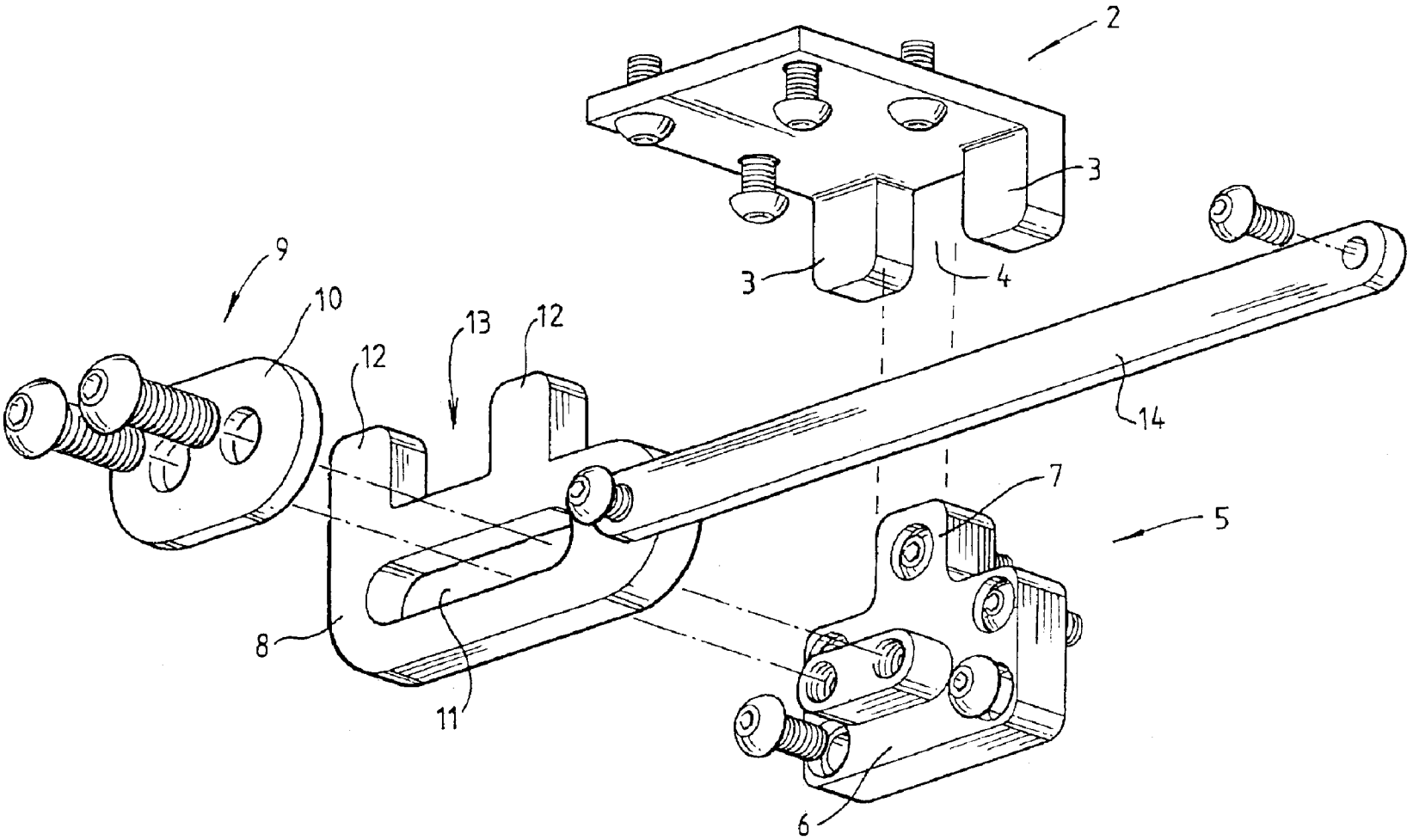
FIG. 8 shows an exploded view of the lock assembly including an extension arm and keeper.

The lock shown in further detail with reference to the exploded view in FIG. 8 which details the manner of assembly of the lock components.

The exemplary lock provides a highly economic and highly secure locking system adapted for a wide range of applications. The lock finds particular application as an auxiliary lock for high security enclosures of the type found in the design of automatic teller banking machines. The increased prevalence of automatic teller banking machines in the public domain has rendered such machines vulnerable to vandalism and theft, and the lock provides an additional level of security to such machines. In particular, an exemplary lock can be retrofitted or fitted during manufacture to the top and bottom of the rear opening doors of automatic teller banking machines.

An exemplary auxiliary lock can be automatically linked to the primary locking action of an ATM sliding bolt such that once the door is closed, the latches cooperate with keepers provided in the internal roof and/or floor of the ATM enclosure (e.g., safe). Once the primary lock is activated, the auxiliary lock is simultaneously activated, drawing the sliding bolt across the keeper lugs to cooperate and interlock with the keeper. The double locking action of the invention ensures that the additional locks prevent the ATM door from being opened either by rotation about the door hinges or by a sliding action if the hinges are vandalized. The double locking action provides a ready capability of retrofitting multipoint locking to existing ATMs and other enclosures.

In an exemplary operation of enhancing the security of an enclosure (e.g., ATM), the method includes fastening one or more locks, each including a matching set of a keeper and latch arrangement, to an enclosure having an openable member, such as a door. The keepers are attached to an interior portion of the enclosure structure, such as the floor or ceiling. The latch arrangement is attached to the door. With the movable bolt 8 is placed in an unlocking position, the door can then be closed (or opened). Pivoting of the door into a closed position causes the mount lug 7 to rest in the aperture 4 between the keeper lugs 3. Closing the door causes the mount lug 7 to come to rest substantially laterally aligned with the keeper lugs 3 while the bolt lugs 12 come to rest beyond the keeper lugs 3. The bolt is then be moved (either separately or automatically when linked with a primary locking arrangement) in a locking direction. For example, the bolt 8 can be slid from the position shown in FIG. 2 to the position shown in FIG. 3. Movement of the bolt causes the bolt lugs 12 to laterally move into an aligned position behind the keeper lugs 3 (which are adjacent to the mount lug 7). Thus, the keeper lugs 3 are trapped by the adjacent side-positioned intermediate mount lug 7 and the rear-positioned bolt lugs 12. With the door closed and the bolt placed in a locking position, the keeper lugs are located intermediate the bolt and the door. The locking arrangement enables each respective keeper lug to be intermediate a respective bolt lug and the door. The lock arrangement places the door securely locked to the enclosure. Thus, the door is prevented from opening by either pivoting action or lateral sliding action thereof. Neither force applied to the door in a pivoting direction nor force applied to the door in a sliding direction is operative to open the locked door.

The operation of unlocking the door includes moving the bolt to its unlocking position. Thus, the bolt lugs are no longer aligned with (behind) the keeper lugs. That is, the keeper lugs are no longer trapped by the bolt lugs, but are separated from each other. With the keeper and latch relationship no longer preventing pivoting movement of the door, the door (without any other feature securing the door) can then be swung to an open position.

An exemplary lock can be fitted during manufacture to a new enclosure or retrofitted to an existing enclosure. A multipoint auxiliary locking arrangement can be retrofit to an existing enclosure already having a primary lock to provide a ready way of providing additional security to the enclosure. An exemplary process of retrofitting an existing enclosure with an auxiliary lock includes attaching a first latch assembly onto the back of the enclosure door at a first vertical elevation, attaching a second latch assembly onto the back of the enclosure door at a second vertical elevation and in generally horizontally aligned relation with the first latch assembly, linking the first latch assembly to the primary lock so that locking an unlocking operation of the primary lock correspondingly controls locking an unlocking operation of the first latch, linking the second latch assembly to the primary lock so that locking an unlocking operation of the primary lock correspondingly controls locking an unlocking operation of the second latch, attaching a first keeper to an interior surface of the enclosure body in generally vertical matching alignment with the first latch assembly, and attaching a second keeper to an interior surface of the enclosure body in generally vertical matching alignment with the first latch assembly and in generally horizontally aligned relation with the first keeper. Closing the door, operating the primary lock toward a locked position to lock the primary lock and simultaneously lock the auxiliary lock (including the first and second latches). Operating the primary lock toward an open position to unlock the primary lock and simultaneously unlock the auxiliary lock, and then opening the door.

An exemplary fitted arrangement is shown in FIG. 1. A latch assembly location can be predetermined, such as by accurately measuring. A first latch assembly is fitted or fastened to the door about midway along the width of the door adjacent to the top edge of the door. During the exemplary fitting of the first latch assembly to the door, the latch mount plate is first mounted to the door by fastening screws, bolts, nuts, and/or other known fastening components. Next the bolt is supportingly fastened to the mount plate by fasteners and a faceplate (or washer). The bolt is fastened to the mount plate, yet slidable relative thereto. For example, the bolt is generally fixed in a direction parallel to the fasteners' axis but movable in a (lateral) direction generally perpendicular to the axis. If the enclosure already includes a primary lock, then the first latch assembly is fitted to the door between the primary lock and an upper door pivoting structure (e.g., upper hinge assembly). The bolt is then attached to an extension arm or link which in turn is attached to the primary lock.

A first keeper is located and fitted or fastened at an upper interior portion (e.g., ceiling) of the enclosure body. The first keeper is securely fixed to the enclosure body by the use of fasteners, as reflected in FIG. 8. The first keeper's mounting location can be calculated and predetermined so that it is in (axial) alignment with the first latch mounted to the door. That is, the keeper is in aligned position with the latch so that the latch mount lug will enter and rest in the keeper aperture.

Similarly, a second latch assembly is fitted or fastened to the door about midway along the width of the door adjacent to the bottom edge of the door. Likewise, if the enclosure already includes a primary lock, then the second latch assembly is fitted to the door between the primary lock and a lower door pivoting structure (e.g., lower hinge assembly).

A second keeper is located and fitted or fastened at a lower interior portion (e.g., floor) of the enclosure body. The second keeper is securely fixed to the enclosure body by the use of (previously discussed) fasteners. The second keeper is positioned on the enclosure body in alignment with the second latch so that the latch mount lug can enter and rest in the keeper aperture.

A corresponding upper latch and keeper arrangement and a corresponding lower latch and keeper arrangement is shown in FIG. 1. The lugs of the upper keeper are arranged in a downward projecting direction toward the interior of the enclosure body while the lugs of the lower keeper are arranged in an upward projecting direction toward the interior of the enclosure body. The lugs of the upper keeper and the lugs of the lower keeper point toward each other. Furthermore, the lugs of the upper latch (i.e., bolt lugs and mount lug) are arranged in an upward projecting direction away from the centre of the door while the lugs of the lower latch are arranged in a downward projecting direction away from the centre of the door. The lugs of the upper latch and the lugs of the lower latch point away from each other. In the exemplary embodiment, the upper and lower keepers are horizontally aligned with each other and the upper and lower latches are horizontally aligned with each other.

Figure 9:
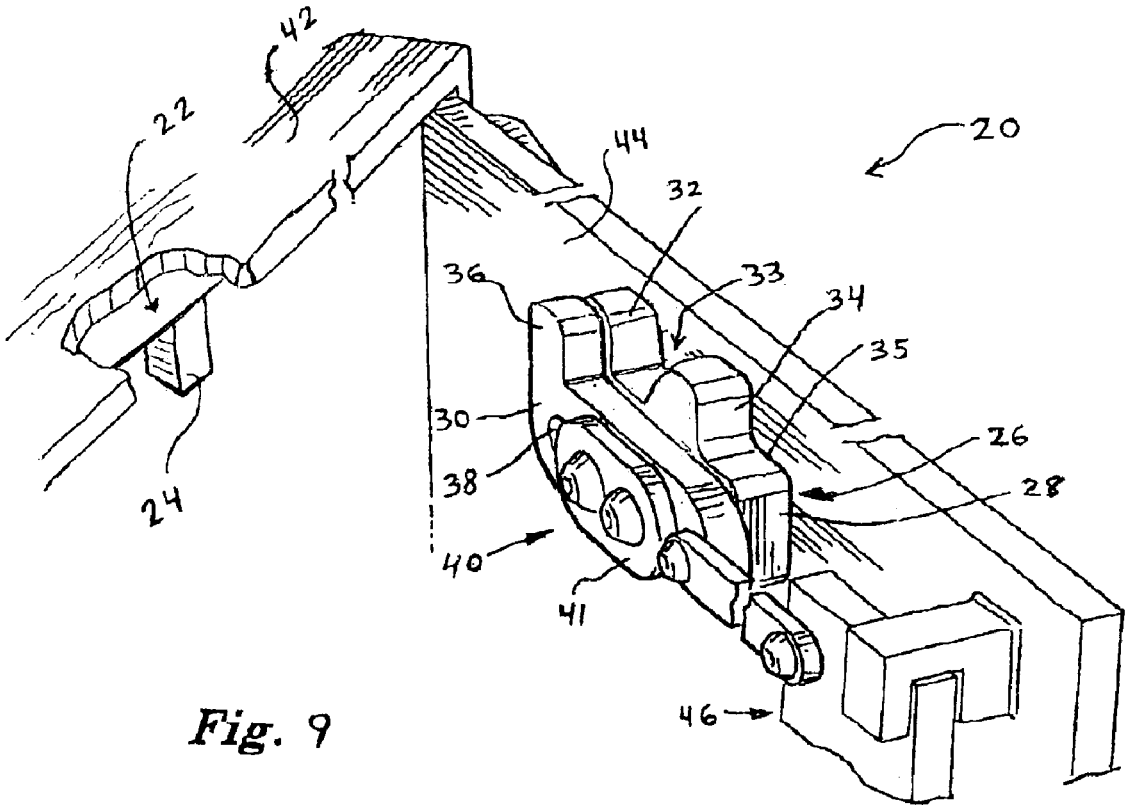
FIG. 9 shows a lock arrangement.

As previously mentioned, other exemplary embodiments can have various arrangements of lugs in the keeper, the bolt, and the mount. For example, a keeper can have a single lug which can fit in an aperture located between two mount lugs. The bolt can have one lug which can slide laterally behind the keeper lug to trap the keeper lug between the mount lugs. Thus, the keeper lug would be surrounded on four sides by the door, the two mount lugs, and the bolt lug. Such a lock arrangement is shown in FIG. 9. The lock 20 includes a keeper 22 and a latch assembly 26. The keeper includes a projection 24. The latch 26 includes a mount 28 and a slide bolt 30. The mount 28 includes two projections 32, 34 formed as part of a one-piece mount plate 35. A mount aperture 33 for receiving the keeper lug 24 is formed between the mount lugs 32, 34. The slide bolt 30 includes one projection lug 36 and a slot 38. Fastening structure 40 can be used to fasten the bolt to the mount via a faceplate 41. Other fastening structure, such as that previously discussed, can be used to fasten the keeper 22 to the enclosure body 42, the mount 28 to the door 44, and the bolt 30 to a primary lock 46. FIG. 9 shows the latch 26 in an open or unlocked position. In the shown lock arrangement of FIG. 9 only four lugs are needed to provide security to the door in both the lateral and pivotal directions. It should be understood that other lock arrangements can include the keeper, the bolt, and the mount each with plural projecting lugs to provide additional securing. The plural lugs would correspond with other plural adjacent lugs to provide the additional securing during the first and second locking actions of the lock.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Thus, the new and improved lock assembly features achieve at least one of the above stated objectives, eliminate difficulties encountered in the use of prior devices and systems, solve problems, and attain the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the details shown and described.

In the following claims any feature described as a means for performing a function shall be construed as encompassing any means capable of performing the recited function, and shall not be limited to the structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods, processes, and relationships are set forth in the appended claims.

We claim:

1. Apparatus including:

a lock adapted to be fastened to an enclosure having a body and a pivotally openable and closeable door, wherein the lock comprising a keeper, wherein the keeper includes at least one projecting keeper lug, wherein the keeper is adapted to be fastened to the enclosure body, wherein the lock comprising a latch assembly, wherein the latch assembly includes a mount, wherein the mount includes a mount plate adapted to be fastened to the enclosure door, wherein the mount plate includes at least one projecting mount lug, wherein the at least one projecting mount lug projects outwardly from the mount plate, wherein a first one of the keeper and the mount plate includes two adjacent lugs spaced apart by an aperture located therebetween, wherein a second one of the keeper and mount plate includes another lug, wherein the aperture is wider than the width of the another lug enabling the aperture to receive the another lug during closing of the door, wherein the latch assembly includes a bolt movable relative to the mount, wherein the bolt includes at least one projecting bolt lug, wherein the bolt is operative to move between a door unlocked first bolt position and a door locking second bolt position, wherein in the first bolt position with the door closed a first bolt lug is aligned with a first mount lug relative to the door, wherein the first mount lug is positioned laterally adjacent to a first keeper lug and the first bolt lug is free to move relative to the first keeper lug, wherein in the second bolt position with the door closed the entire first keeper lug is intermediate the first bolt lug and the door, wherein the first bolt lug is out of alignment with the first mount lug, wherein the door is prevented from opening by both pivoting action and lateral sliding action.

2. The apparatus according to claim 1 wherein the keeper includes at least two projecting spaced apart keeper lugs, wherein a keeper aperture is located between two adjacent keeper lugs, wherein in the first bolt position with the door closed the first mount lug is positioned within the keeper aperture.

3. The apparatus according to claim 2 wherein the bolt includes at least two projecting spaced apart bolt lugs, wherein a bolt aperture is located between two adjacent bolt lugs, wherein in the first bolt position one of the bolt lugs is aligned with the first mount lug, wherein the bolt lugs are free to move relative to the keeper.

4. The apparatus according to claim 3 wherein in the second bolt position with the door closed each respective bolt lug is aligned behind a corresponding keeper lug.

5. The apparatus according to claim 1 wherein the bolt is adapted to move by linear sliding action.

6. The apparatus according to claim 1 wherein the bolt includes a keyway to guiding the movement of the bolt relative to the mount and to provide limited travel between the first and second bolt positions.

7. The apparatus according to claim 2 wherein the first mount lug is substantially the same thickness as the two adjacent keeper lugs.

8. The apparatus according to claim 1 wherein the bolt is attached to the mount via a faceplate.

9. The apparatus according to claim 1 and further comprising an enclosure having a body and a pivotally openable and closeable door, wherein the keeper is fitted to the enclosure body, and wherein the mount plate is fitted to the enclosure door.

10. The apparatus according to claim 9 wherein the enclosure comprises a safe.

11. The apparatus according to claim 9 wherein the enclosure comprises part of an automatic teller machine.

12. The apparatus according to claim 9 wherein the enclosure comprises an existing enclosure that has been retrofit with the lock.

13. The apparatus according to claim 1 and further comprising an automatic teller machine (ATM), wherein the ATM comprises an enclosure body and an enclosure door, wherein the enclosure door is operatively connected to the enclosure body, wherein the keeper is fastened to the enclosure body, and wherein the mount plate is fastened to the enclosure door.

14. The apparatus according to claim 1 wherein the keeper is adapted to be fastened to the enclosure body with the first keeper lug projecting into an internal space of the enclosure body.

15. Apparatus including:

a lock adapted to be fastened to an enclosure having a body and a pivotally openable and closeable door, wherein the lock comprising a keeper, wherein the keeper is adapted to be fastened to the enclosure body, wherein the keeper includes at least two projecting spaced apart keeper lugs, wherein a keeper aperture is located between two adjacent keeper lugs, wherein the lock comprising a latch assembly, wherein the latch assembly includes a mount, wherein the mount includes a mount plate adapted to be fastened to the enclosure door, wherein the mount plate includes a projecting mount lug, wherein the latch assembly includes a bolt movable relative to the mount, wherein the bolt includes at least two projecting spaced apart bolt lugs, wherein a bolt aperture is located between two adjacent bolt lugs, wherein the width of the keeper aperture is wider than the width of at least one bolt lug and the bolt aperture is wider than the width of at least one keeper lug, wherein the at least one bolt lug can pass through the keeper aperture and the at least one keeper lug can pass through the bolt aperture during opening and closing of the door, wherein the bolt is operative to move between a door unlocked first bolt position and a door locking second bolt position, wherein in the first bolt position with the door closed a first bolt lug is aligned with a first mount lug, the first mount lug is positioned within the keeper aperture, the first mount lug is positioned laterally adjacent to a first keeper lug, and the bolt lugs are free to move relative to the keeper, wherein in the second bolt position with the door closed the first keeper lug is intermediate the first bolt lug and the door, wherein the door is prevented from opening by both pivoting action and lateral sliding action.

16. Apparatus including:

an auxiliary lock adapted to be fastened to an enclosure having a body and a pivotally openable and closeable door, wherein the lock comprising a keeper,
wherein the keeper includes at least one projecting keeper lug,
wherein the keeper is adapted to be fastened to the body,
wherein the lock comprising a latch assembly,
wherein the latch assembly includes a mount,
wherein the mount includes a mount plate adapted to be fastened to the door,
wherein the mount plate includes a projecting mount lug,
wherein the latch assembly includes a bolt movable relative to the mount,
wherein the bolt includes at least one projecting bolt lug,
wherein the bolt is operative to move between a door unlocked first bolt position and a door locking second bolt position,
wherein in the first bolt position a first bolt lug is aligned with a first mount lug, wherein with the door closed the first mount lug is positioned laterally adjacent to a first keeper lug and the first bolt lug is free to move relative to the first keeper lug,
wherein in the second bolt position with the door closed the first keeper lug is intermediate the first bolt lug and the door, wherein the door is prevented from opening by both pivoting action and lateral sliding action,
an auxiliary lock activation member adapted to cooperate with a primary lock fitted to the door, wherein locking activation of the primary lock automatically locks the auxiliary lock.

17. The apparatus according to claim 16 and further comprising a primary lock, wherein the auxiliary lock is linked to the primary lock via the activation member, wherein activation of the primary lock automatically correspondingly activates the auxiliary lock.

18. The apparatus according to claim 17 and further comprising a door and door pivoting structure, wherein the auxiliary lock is fitted to the door about midway along the door between the primary lock and the door pivoting structure.

19. The apparatus according to claim 18 wherein the door pivoting structure includes at least one hinge attaching the door to the enclosure body.

20. Apparatus including:
an enclosure having a body and a pivotally openable and closeable door,
a lock adapted to be fastened to the enclosure,
wherein the lock comprising a keeper,
wherein the keeper includes at least one projecting keeper lug,
wherein the keeper is fitted to the body,
wherein the lock comprising a latch assembly,
wherein the latch assembly includes a mount,
wherein the mount includes a mount plate,
wherein the mount plate includes a projecting mount lug,
wherein the mount plate is fitted to the door,
wherein the latch assembly includes a bolt movable relative to the mount,
wherein the bolt includes at least one projecting bolt lug,
wherein the bolt is operative to move between a door unlocked first bolt position and a door locking second bolt position,
wherein in the first bolt position a first bolt lug is aligned with a first mount lug, wherein with the door closed the first mount lug is positioned laterally adjacent to a first keeper lug and the first bolt lug is free to move relative to the first keeper lug,
wherein in the second bolt position with the door closed the first keeper lug is intermediate the first bolt lug and the door, wherein the door is prevented from opening by both pivoting action and lateral sliding action,
a second lock,
wherein the second lock includes a second keeper fitted to the body, and
wherein the second lock includes a second latch assembly carried on the door.

21. Apparatus including:
an automatic teller machine (ATM),
wherein the ATM includes a safe enclosure body and a pivotally openable and closeable safe enclosure door,
wherein the enclosure door is operatively connected to the enclosure body,
wherein the enclosure door comprises an interior side and an exterior side,
wherein with the enclosure door closed the interior side faces toward an internal space of the enclosure body,
wherein with the enclosure door closed the exterior side faces away from the internal space of the enclosure body,
wherein the ATM includes at least one lock,
wherein each lock comprising a keeper,
wherein the keeper is fastened to the enclosure body,
wherein the keeper includes at least one projecting keeper lug,
wherein the at least one projecting keeper lug is located inside the enclosure body,
wherein each lock comprising a latch assembly,
wherein the latch assembly includes a mount,
wherein the mount includes a mount plate,
wherein the mount plate is fastened to the interior side of the enclosure door,
wherein the mount plate includes a projecting mount lug,
wherein the latch assembly includes a bolt movable relative to the mount,
wherein the bolt includes at least one projecting bolt lug,
wherein the bolt is operative to move between an enclosure door unlocked first bolt position and an enclosure door locking second bolt position,
wherein in the first bolt position a first bolt lug is aligned with a first mount lug, wherein with the enclosure door closed the first mount lug is positioned laterally adjacent to a first keeper lug and the first bolt lug is free to move relative to the first keeper lug,
wherein in the second bolt position with the enclosure door closed the entire first keeper lug is intermediate the first bolt lug and the enclosure door, wherein the first bolt lug is out of alignment with the first mount lug, wherein the enclosure door is prevented from opening by both pivoting action and lateral sliding action.

* * * * *